US007762859B2

(12) United States Patent
Suzuki et al.

(10) Patent No.: US 7,762,859 B2
(45) Date of Patent: Jul. 27, 2010

(54) PROPULSION SYSTEM FOR BOAT

(75) Inventors: Takayoshi Suzuki, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 44 days.

(21) Appl. No.: 12/389,436

(22) Filed: Feb. 20, 2009

(65) Prior Publication Data

US 2009/0215330 A1 Aug. 27, 2009

(30) Foreign Application Priority Data

Feb. 22, 2008 (JP) ..... 2008-041019

(51) Int. Cl.
*B63H 23/00* (2006.01)

(52) U.S. Cl. ..... 440/1; 440/86

(58) Field of Classification Search ..... 440/1, 440/52, 80, 81, 86; 477/110, 111, 154; 367/135, 367/141; 701/48, 54
See application file for complete search history.

(56) References Cited

U.S. PATENT DOCUMENTS 3,757,288 A * 9/1973 Morin ..... 367/135
5,613,887 A * 3/1997 Kobayashi ..... 440/47
5,711,742 A 1/1998 Leinonen et al.
5,888,108 A 3/1999 Iriono
6,206,646 B1 * 3/2001 Bucher ..... 417/63

FOREIGN PATENT DOCUMENTS

JP 09-263294 A 10/1997

* cited by examiner

*Primary Examiner*—Lars A Olson
(74) *Attorney, Agent, or Firm*—Keating & Bennett, LLP

(57) ABSTRACT

A propulsion system for a boat includes propellers arranged to be rotated by an engine, a transmission mechanism arranged to transmit driving force of the engine to the propellers such that a speed of the driving force of the engine is changed at least with a gear reduction ratio for low speed and high speed, and a control unit arranged to output a signal to control a gear shift in the transmission mechanism on the basis of an amount of lever opening, which is based on operation of a control lever section, and speed of the engine, and the control unit being arranged to detect cavitation generated in conjunction with rotation of the propellers on the basis of a gear shift control map. The control unit is arranged to control output of a signal to the transmission mechanism for changing a reduction gear to that for high speed when cavitation is detected.

13 Claims, 11 Drawing Sheets

Timing chart corresponding to trajectory P1

PROPULSION SYSTEM FOR BOAT

BACKGROUND OF THE INVENTION

1. Field of the Invention

The present invention relates to a propulsion system for a boat. More specifically, the present invention relates to a propulsion system for a boat equipped with an engine.

2. Description of the Related Art

Conventionally, a propulsion unit for a boat equipped with an engine (a propulsion system for a boat) has been known (see JP-A-Hei 9-263294, for example). JP-A-Hei 9-263294 discloses a propulsion unit for a boat equipped with an engine and a power transmission mechanism for transmitting a driving force of the engine to a propeller at a given, fixed gear reduction ratio. This propulsion unit is constructed such that the driving force of the engine is directly transmitted to the propeller through the power transmission mechanism and such that rotational speed of the propeller increases as the engine speed increases.

However, in the propulsion unit (propulsion system) disclosed in JP-A-Hei 9-263294, it is difficult to improve acceleration performance at low speed if the gear reduction ratio of the power transmission mechanism is arranged to increase the maximum speed. On the contrary, if the gear reduction ratio of the power transmission mechanism is arranged to improve the acceleration performance at low speed, it is difficult to increase the maximum speed. That is, in the propulsion unit for a boat disclosed in JP-A-Hei 9-263294, it is difficult to achieve both the acceleration and maximum speed performance levels that an operator of a boat desires.

SUMMARY OF THE INVENTION

In order to overcome the problems described above, preferred embodiments of the present invention provide a propulsion system for a boat in which levels of acceleration and maximum speed desired by an operator of a boat are achieved.

A propulsion system for a boat according to a preferred embodiment of the present invention includes an engine; a propeller arranged to be rotated by engine drive; a transmission mechanism arranged to transmit a driving force of the engine to the propeller such that a speed of the driving force of the engine is changed at least with a gear reduction ratio for one of a low speed and a high speed; a control lever section arranged to be operated by a user to control the engine drive; a control section arranged to output a signal to control gear shift in the transmission mechanism on the basis of lever opening, which is based on the user's operation of the control lever section, and the engine speed; and a cavitation detecting section arranged to detect a cavitation generated in conjunction with rotation of the propeller. The control section is configured to control output of a signal which is transmitted to the transmission mechanism and by which the gear reduction ratio is changed to the one for high speed when cavitation is detected by the cavitation detecting section.

As described above, the propulsion system for a boat according to this preferred embodiment of the present invention includes the transmission mechanism that is arranged to transmit the driving force generated by the engine to the propeller such that a speed of the driving force of the engine is changed at least with the gear reduction ratio for low speed and high speed. Therefore, it is possible to improve the accelerating performance at low speed by arranging the transmission mechanism to transmit the driving force generated by the engine to the propeller such that the speed of the driving force is changed with the gear reduction ratio for low speed. In addition, it is possible to increase the maximum speed by arranging the transmission mechanism to transmit the driving force generated by the engine to the propeller in a state that the speed of the driving force is changed with the gear reduction ratio for high speed. Consequently, both the acceleration and maximum speed can be brought closer to the performance levels that an operator of a boat desires.

It is also possible to easily detect an occurrence of cavitation by providing the cavitation detecting section to detect the cavitation generated in conjunction with the rotation of the propeller. Here, cavitation is a phenomenon of mass formation of vapor bubbles in a region close to the propeller in conjunction with the rotation of the propeller in a liquid (for example, water), which reduces or indicates possible reduction of propulsive force of the propeller.

The control section is arranged to output a signal to the transmission mechanism so that the transmission mechanism shifts to the gear reduction ratio for high speed when the cavitation detecting section detects cavitation. Accordingly, if the increased engine speed exceeds the engine speed that can correspond to the accelerator opening (lever opening) due to the cavitation occurrence, the transmission mechanism can shift to the gear reduction ratio for high speed. In this case, because engine torque decreases while resistance of the propeller against water remains the same, rotational speeds of the engine and the propeller can be reduced. As a result, because the cavitation dies down, it is possible to suppress a decrease in propulsive force of the propeller.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will hereinafter be described with reference to the drawings.

Figure 1:
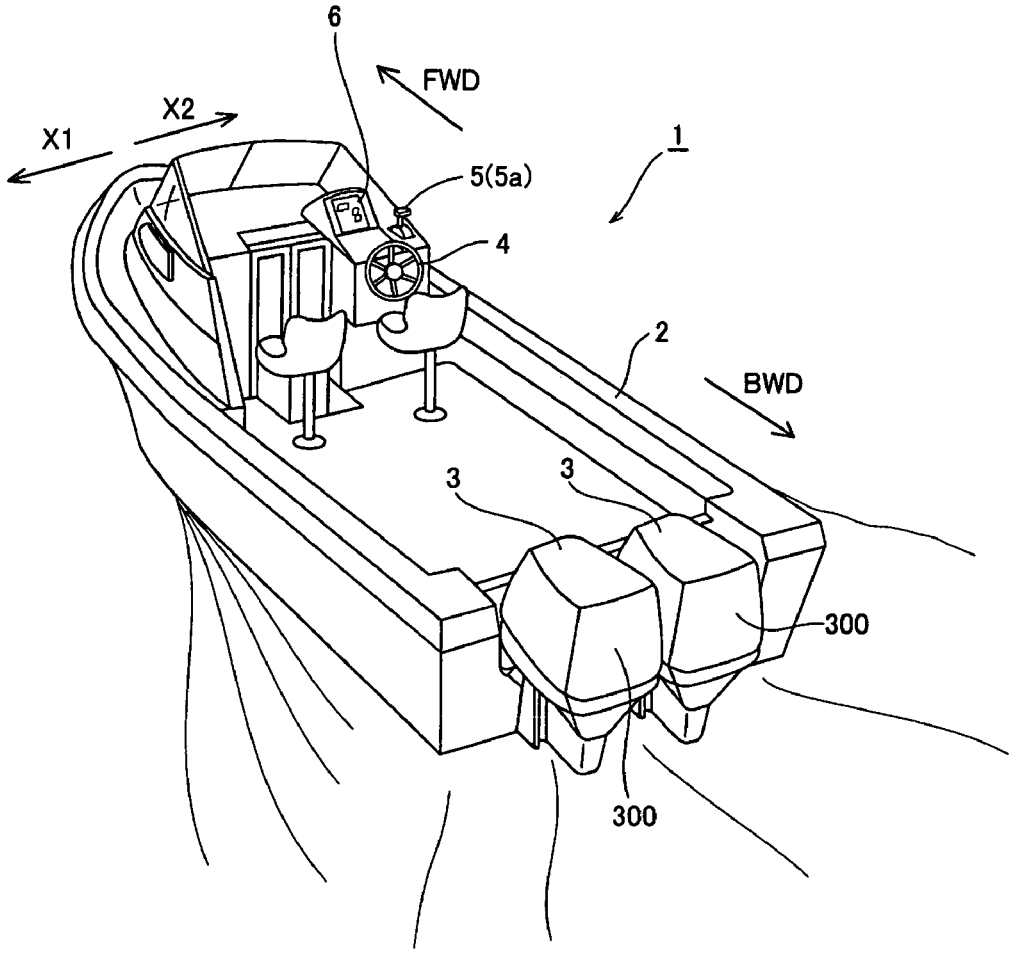
FIG. 1 is a perspective view of a boat on which a propulsion system for a boat according to a preferred embodiment of the present invention is mounted.
Figure 2:
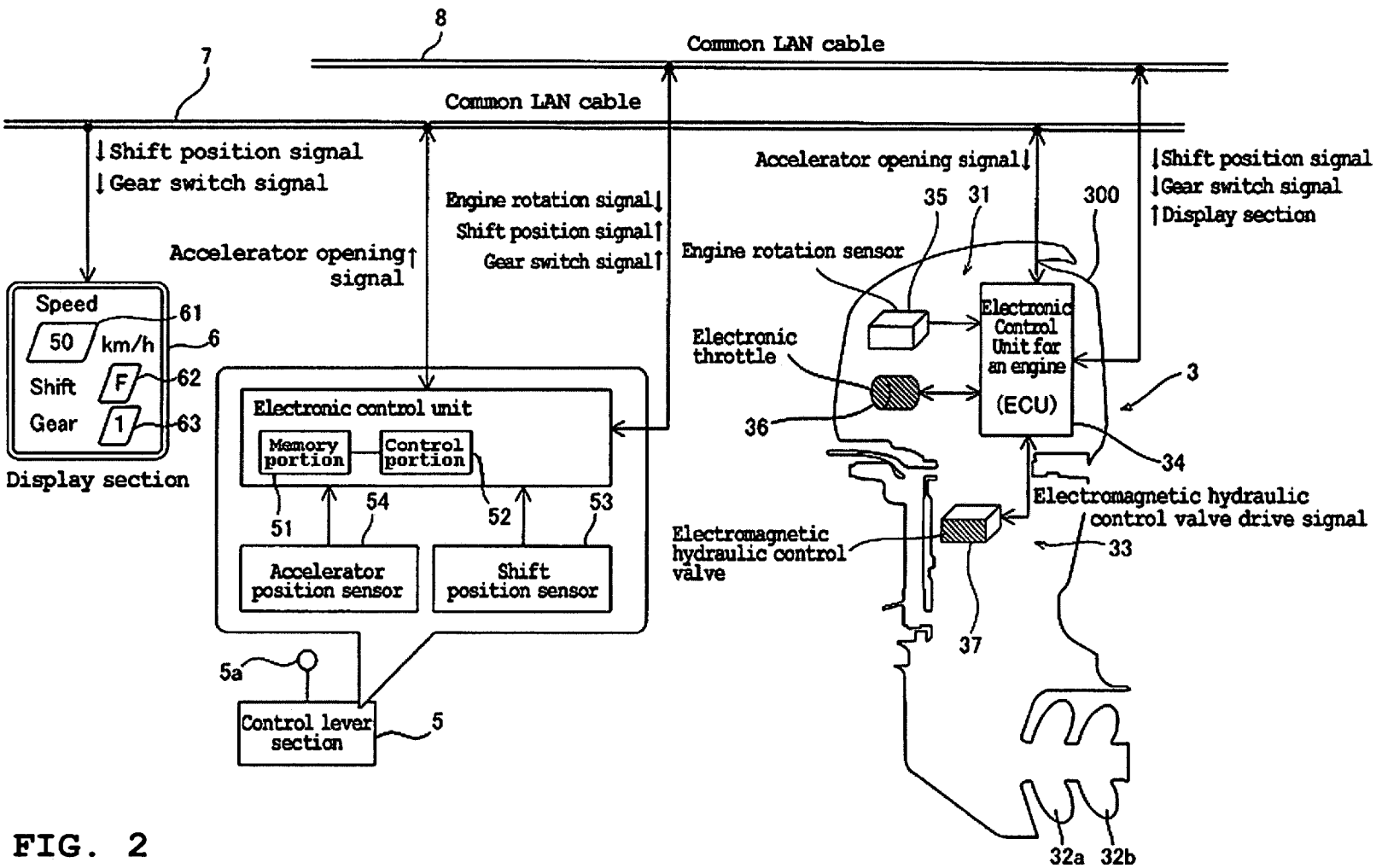
FIG. 2 is a block diagram showing configuration of the propulsion system for a boat according to a preferred embodiment of the present invention.

FIG. 1 is a perspective view of a boat on which a propulsion system for a boat according to a preferred embodiment of the present invention is mounted. FIG. 2 is a block diagram showing the configuration of the propulsion system for a boat according to a preferred embodiment of the present invention. FIGS. 3 to 7 are drawings explaining in detail the configuration of the propulsion system for a boat according to a preferred embodiment of the present invention. In the drawings, FWD indicates a forward direction of the boat, and BWD indicates a backward direction thereof. Referring to FIGS. 1 to 7, a description will now be made of the configuration of a boat 1 according to a preferred embodiment of the present invention and a configuration of the propulsion system for a boat, which is mounted on the boat 1.

As shown in FIG. 1, the boat 1 according to a preferred embodiment is preferably provided with a hull 2 arranged to float on the water, two outboard motors 3 that are attached to the stern of the hull 2 to propel the hull 2, a steering section 4 arranged to steer the hull 2, a control lever section 5 disposed near the steering section 4 and includes a longitudinally-turnable lever portion 5*a*, and a display section 6 disposed in proximity of the control lever section 5. As shown in FIG. 2, the outboard motors 3, the control lever section 5, and the display section 6 are connected by common LAN cables 7, 8. Here, the outboard motors 3, the steering section 4, the control lever section 5, the display section 6, and the common LAN cables 7, 8 define the propulsion system for a boat.

As shown in FIG. 1, the two outboard motors 3 are preferably symmetrically arranged about the center in a width direction of the hull 2 (an arrow X1 direction and an arrow X2 direction). In addition, the outboard motors 3 are covered with a case 300. This case 300 is preferably made of resin, for example, and functions to protect the interior of the outboard motor 3 against water and the like. As shown in FIG. 2, the outboard motor 3 preferably includes an engine 31, two propellers 32*a*, 32*b* arranged to convert a driving force of the engine 31 into a propulsive force of the boat 1 (see FIG. 4), a transmission mechanism 33 arranged to transmit the driving force generated by the engine 31 to the propellers 32*a* and 32*b* in a state that the driving force of the engine 31 is shifted to at least one of a gear reduction ratio for low speed (approximately 1.33:1.00) and high speed (approximately 1.00:1.00), and an ECU (Electronic Control Unit for an engine) 34 arranged to electrically control the engine 31 and the transmission mechanism 33. The ECU 34 is preferably connected with an engine rotation sensor 35 arranged to detect rotational speed of the engine 31 and an electronic throttle 36 arranged to control an opening of a throttle valve (not shown) of the engine 31 on the basis of an accelerator opening signal, which will be described below. The engine rotation sensor 35 is disposed in proximity of a crankshaft 301 of the engine 31 (see FIG. 4), and functions to detect rotational speed of the crankshaft 301 and to transmit the detected rotational speed of the crankshaft 301 to the ECU 34. Here, the rotational speed of the crankshaft 301 is an example of an "engine speed" according to a preferred embodiment of the present invention. The electronic throttle 36 not only functions to control the opening of the throttle valve (not shown) of the engine 31 on the basis of the accelerator opening signal from the ECU 34, but also functions to transmit a throttle valve opening signal to the ECU 34 and a control unit 52, which will be described below.

The ECU 34 has a function to generate an electromagnetic hydraulic control valve drive signal on the basis of a gear switch signal and a shift position signal that are transmitted from the control unit 52 of the control lever section 5, which will be described below. The ECU 34 is connected with an electromagnetic hydraulic control valve 37, and controls transmission of the electromagnetic hydraulic control valve drive signal to the electromagnetic hydraulic control valve 37. The transmission mechanism 33 is controlled when the electromagnetic hydraulic control valve 37 is driven based on the electromagnetic hydraulic control valve drive signal. The structure and operation of the transmission mechanism 33 will be described in detail below.

The control lever section 5 preferably contains a memory 51 arranged to store a gear shift control map, which will be described below, and the control unit 52 arranged to generate signals (gear switch signal, shift position signal, and accelerator opening signal) that are transmitted to the ECU 34. The control unit 52 is an example of the "cavitation detecting section" according to a preferred embodiment of the present invention. Furthermore, the control lever section 5 contains a shift position sensor 53 arranged to detect the shift position of the lever portion 5*a* and an accelerator position sensor 54 arranged to detect an amount of lever opening (accelerator opening), which is opened or closed with the operation of the lever portion 5*a*. The shift position sensor 53 is provided to detect whether the lever portion 5*a* is in a neutral position, in a front position, or in a rear position. The memory 51 and the control unit 52 are connected to each other, and the control unit 52 can read out the gear shift control map, etc. that are stored in the memory 51. The control unit 52 is also connected to both the shift position sensor 53 and the accelerator position sensor 54. Therefore, the control unit 52 can obtain a detection signal detected by the shift position sensor 53 (the shift position sensor) and the accelerator opening signal detected by the accelerator position sensor 54.

The control unit 52 is connected to the common LAN cables 7, 8. These common LAN cables 7, 8 are connected to the ECU 34 and function to transmit a signal generated in the control unit 52 to the ECU 34 and to transmit a signal generated in the ECU 34 to the control unit 52. That is, the common LAN cables 7, 8 are arranged to communicate between the control unit 52 and the ECU 34. The common LAN cable 8 is electrically independent of the common LAN cable 7.

More specifically, the control unit 52 transmits the shift position signal of the lever portion 5*a*, which is detected by the shift position sensor 53, to the display section 6 and the ECU 34 through the common LAN cable 7. Here, the control unit 52 does not transmit the shift position signal through the common LAN cable 8 but only through the common LAN cable 7. The control unit 52 also transmits the accelerator opening signal detected by the accelerator position sensor 54 to the ECU 34 not through the common LAN cable 7 but through the common LAN cable 8. In addition, the control unit 52 can receive an engine rotation signal, which is transmitted from the ECU 34, through the common LAN cable 8.

In this preferred embodiment, the control unit 52 has a function to electrically control the transmission mechanism 33 so as to change the gear reduction ratio of the transmission mechanism 33 on the basis of the operation of the control lever section 5 by the operator. More specifically, based on the gear shift control map defined by the lever opening (accelerator opening) stored in the memory 51 and the engine speed, the control unit 52 functions to generate the gear switch signal arranged to control the transmission mechanism 33 so as to change the gear reduction ratio to the low speed. The gear shift control map will be described in detail below. Then, the control unit 52 transmits the generated gear switch signal to the ECU 34 through the common LAN cables 7, 8.

When the lever portion 5*a* of the control lever section 5 is turned to the front (the arrow FWD direction) (see FIG. 3), the transmission mechanism 33 controls the hull 2 to travel forward. Meanwhile, when the lever portion 5*a* is not longitudinally turned (see the solid line in FIG. 3), the transmission mechanism 33 controls the hull 2 in the neutral position in which the hull 2 does not travel either forward or backward. When the lever portion 5*a* of the control lever section 5 is turned to the rear (an opposite direction from the arrow FWD direction) (see FIG. 3), the transmission mechanism 33 controls the hull 2 to travel backward.

Figure 3:
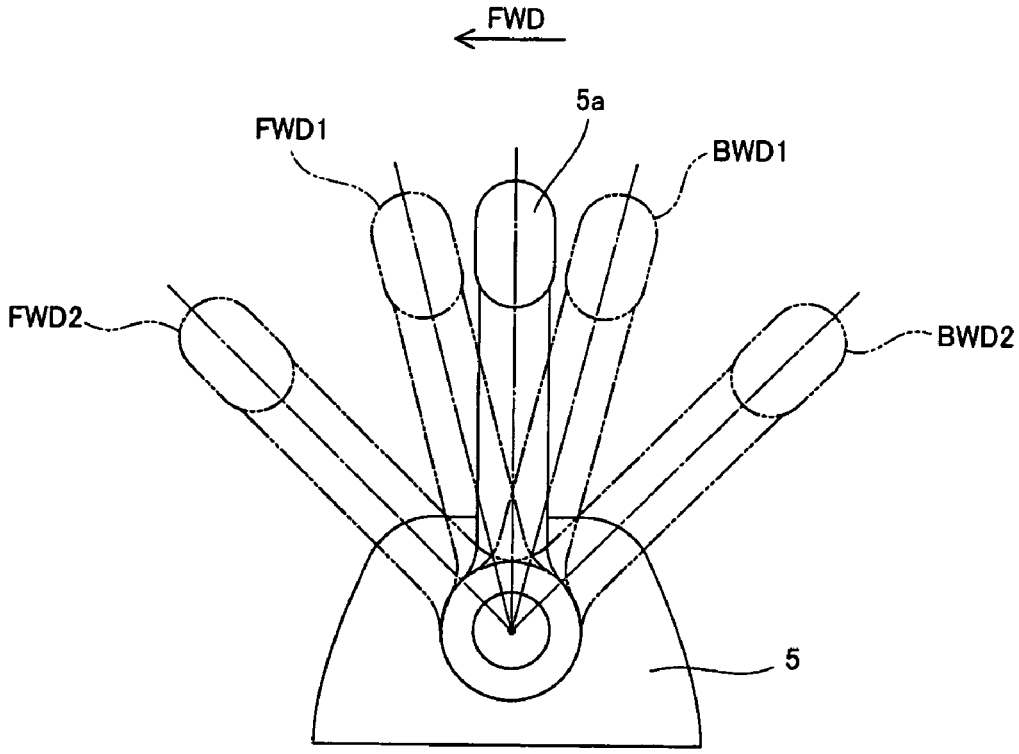
FIG. 3 is a side view describing configuration of a control lever section of the propulsion system for a boat according to a preferred embodiment of the present invention.

When the lever portion 5*a* of the control lever section 5 is turned to the position at FWD1 of FIG. 3, it is configured to shift in (cancel the neutral state) while the throttle valve of the engine 31, which is not shown, is fully closed (in an idling state). It is also configured that the throttle valve of the engine 31, which is not shown, is fully opened when the lever portion 5*a* of the control lever section 5 is turned to the position at FWD2 of FIG. 3.

In addition, similar to the case that the lever portion 5*a* of the control lever section 5 is turned in the arrow FWD direction, when the lever portion 5*a* is turned to the position at BWD1 of FIG. 3, which is the opposite direction from the arrow FWD direction, it is configured to shift in (cancel the neutral state) while the throttle valve of the engine 31, which is not shown, is fully closed (in the idling state). It is also configured that the throttle valve of the engine 31, which is not shown, is fully opened when the lever portion 5*a* of the control lever section 5 is turned to the position at BWD2 of FIG. 3.

The display section 6 includes a speed indicator 61 that indicates the navigation speed of the boat 1, a shift position indicator 62 that indicates the shift position of the lever portion 5*a* of the control lever section 5, and a gear indicator 63 that indicates an engaged gear in the transmission mechanism 33. The navigation speed of the boat 1, which is displayed in the speed indicator 61, is calculated by the ECU 34 on the basis of the engine rotation sensor 35, an air-intake state of the engine 31, and the like. Then, the calculated navigation speed data of the boat 1 is transmitted to the display section 6 through the common LAN cables 7, 8. The shift position is displayed in the shift position indicator 62 on the basis of the shift position signal transmitted from the control unit 52 of the control lever section 5. In addition, the engaged gear in the transmission mechanism 33 is displayed in the gear indicator 63 on the basis of the gear switch signal transmitted from the control unit 52 of the control lever section 5. That is, the display section 6 functions to inform the operator of the navigating state of the boat 1.

Figure 4:
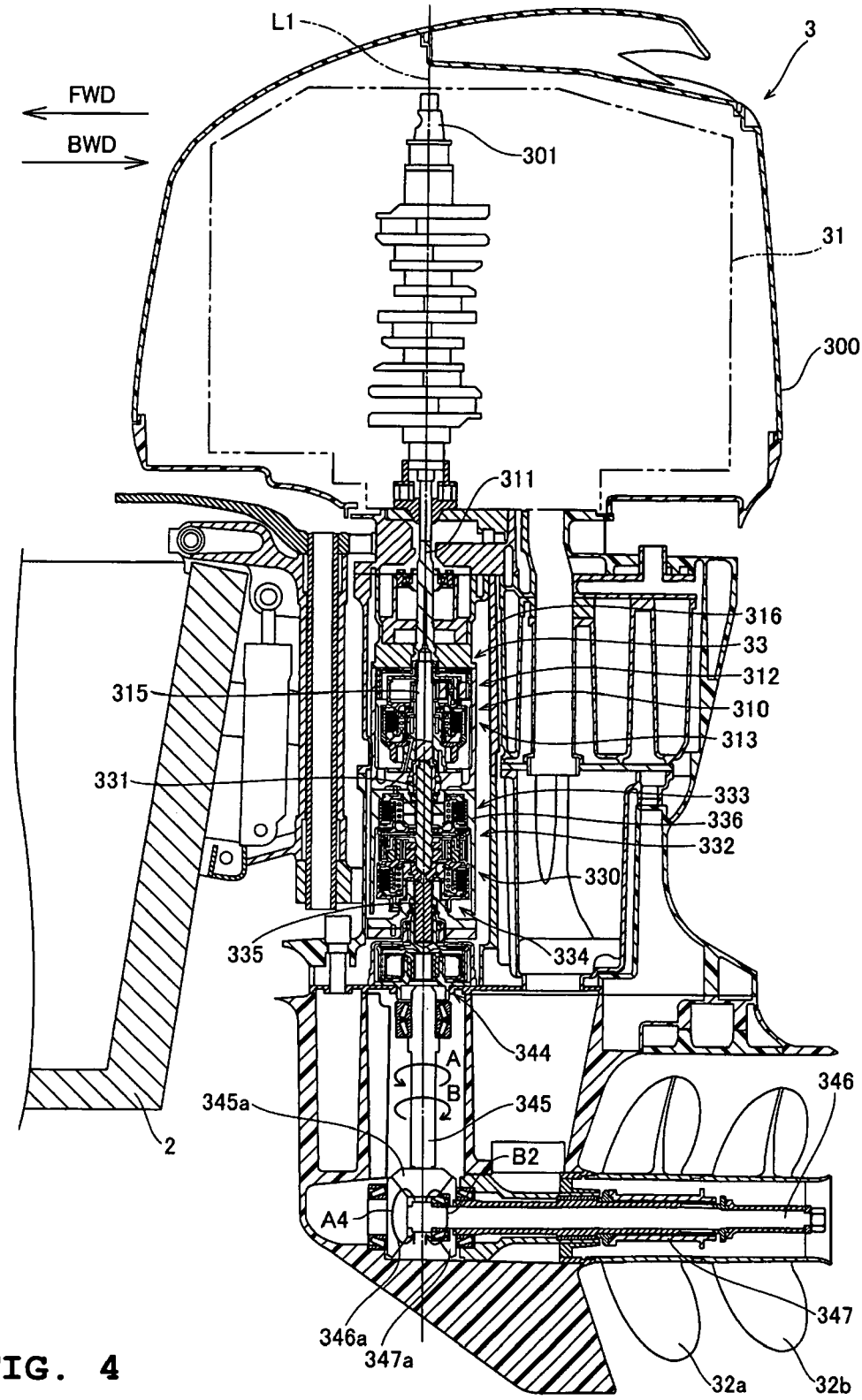
FIG. 4 is a cross-sectional view describing a configuration of a main body of the propulsion system for a boat according to a preferred embodiment of the present invention.

Next, structure of the engine 31 and the transmission mechanism 33 will be described. As shown in FIG. 4, the crankshaft 301 that rotates about an axis L1 is provided in the engine 31. The driving force of the engine 31 is generated by the rotation of this crankshaft 301. An upper portion of an upper transmission shaft 311 of the transmission mechanism 33 is connected to the crankshaft 301. This upper transmission shaft 311 is disposed on the axis L1 and rotates about the axis L1 in conjunction with the rotation of the crankshaft 301.

The transmission mechanism 33 includes the above-mentioned upper transmission shaft 311 to which the driving force of the engine 31 is input, and preferably includes an upper transmission 310 and a lower transmission 330. The upper transmission 310 changes the gears such that the boat 1 is able to travel either at high speed or at low speed. The lower transmission 330 shifts the gears so that the boat 1 is able to travel either forward or backward. In other words, the transmission mechanism 33 is arranged to transmit the driving force generated by the engine 31 to the propellers 32*a* and 32*b* in a state that the driving force of the engine 31 is changed to a gear reduction ratio for low speed (approximately 1.33:1, for example) and high speed (approximately 1:1, for example) in the forward or backward travel.

Figure 5:
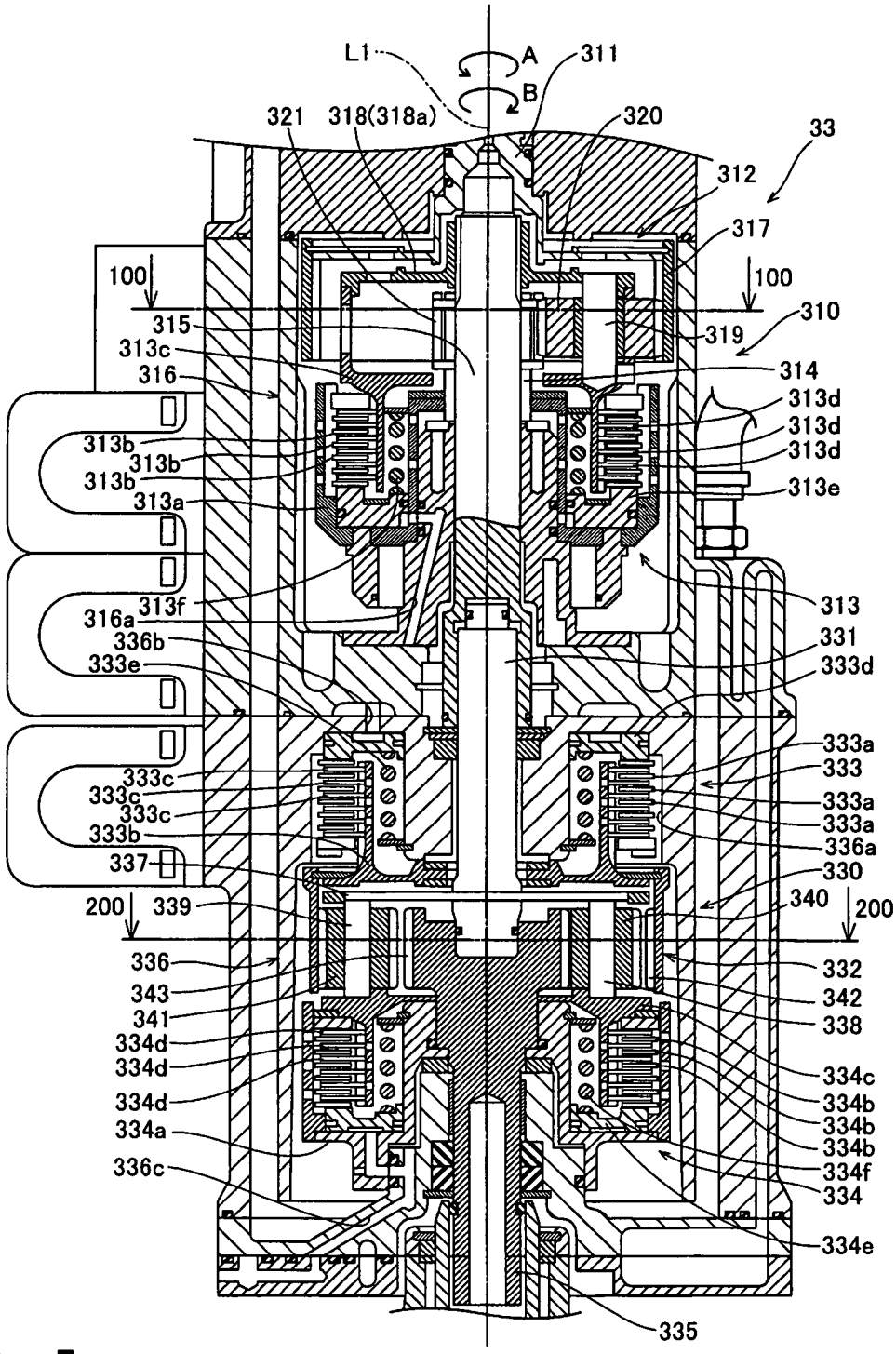
FIG. 5 is a cross-sectional view describing a configuration of a transmission mechanism of the main body of the propulsion system for a boat according to a preferred embodiment of the present invention.

As shown in FIG. 5, the upper transmission 310 includes the above-mentioned upper transmission shaft 311, a planetary gear train 312 arranged to decelerate the driving force of the upper transmission shaft 311, a clutch section 313 and a one-way clutch 314 arranged to control the rotation of the planetary gear train 312, an intermediate shaft 315 to which the driving force of the upper transmission shaft 311 is transmitted through the planetary gear train 312, and an upper casing 316 that defines the contour of the upper transmission 310 with a plurality of members. When the clutch section 313 is engaged, the intermediate shaft 315 is arranged to rotate without being substantially decelerated in comparison with the rotational speed of the upper transmission shaft 311. On the contrary, when the clutch section 313 is disengaged, the planetary gear train 312 rotates, and the intermediate shaft 315 rotates at a reduced speed lower than the rotational speed of the upper transmission shaft 311.

Figure 6:
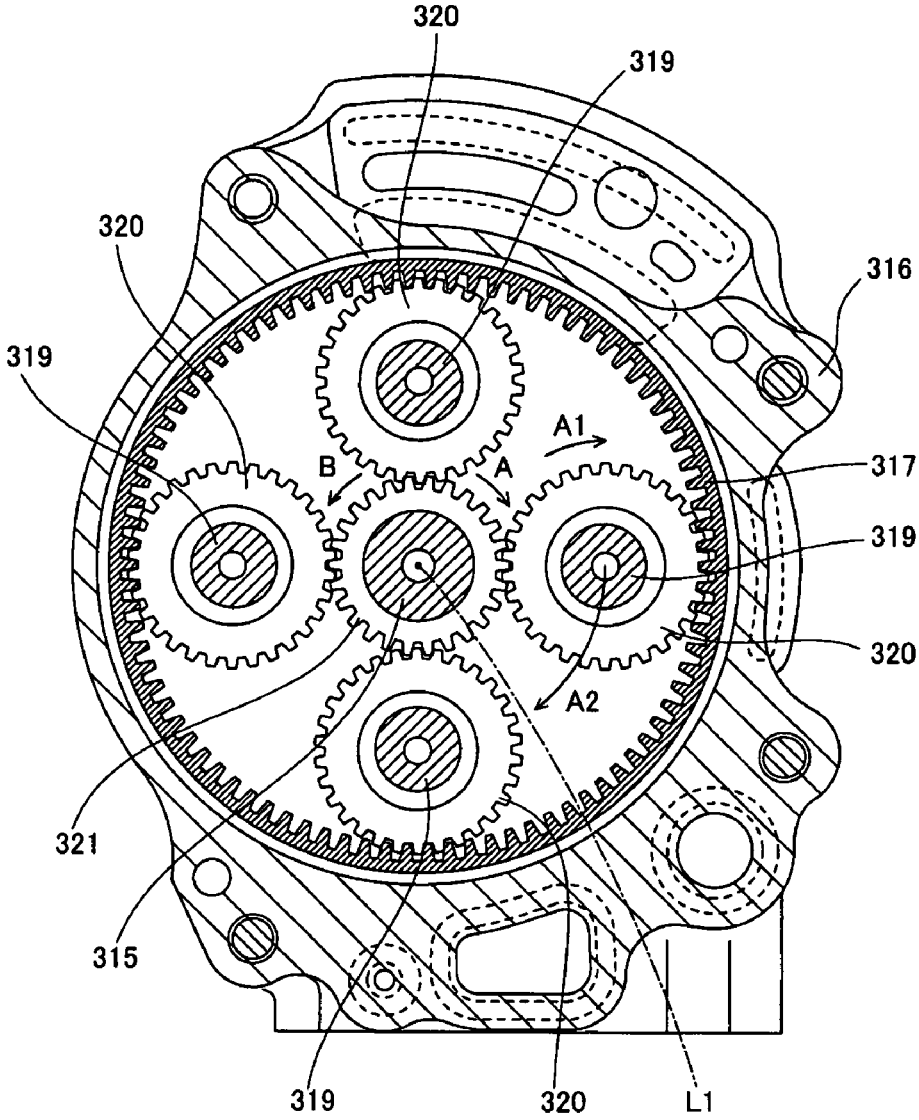
FIG. 6 is a cross-sectional view taken along the line of FIG. 5.

More specifically, a ring gear 317 is provided on a lower portion of the upper transmission shaft 311. In addition, a flange member 318 is preferably spline-fitted to an upper portion of the intermediate shaft 315. This flange member 318 is disposed on the inner side of the ring gear 317 (the axis L1 side), and four shaft members 319 are fixed to a flange portion 318*a* of the flange member 318 as shown in FIGS. 5 and 6. Four planetary gears 320 are each rotatably attached to the shaft members 319 and are meshed with the ring gear 317. The four planetary gears 320 are also meshed with a sun gear 321 that is rotatable about the axis L1. As shown in FIG. 5, this sun gear 321 is supported by the one-way clutch 314. Moreover, the one-way clutch 314 is attached to the upper casing 316 and is only rotatable in a direction A. Therefore, the sun gear 321 rotates only in one direction (the A direction).

The clutch section 313 is preferably a wet-type multiplate clutch. The clutch section 313 mainly includes an outer case 313*a* that is supported by the one-way clutch 314 to rotate only in the A direction, plural clutch plates 313*b* that are disposed on the inner periphery of the outer case 313*a* with a given distance between each other, an inner case 313*c* that is at least partially disposed inside the outer case 313*a*, and plural clutch plates 313*d* that are attached to the inner case 313*c* and are each disposed between the multiple clutch plates 313*b*. Then, the clutch section 313 becomes an engaged state in which the outer case 313*a* and the inner case 313*c* integrally rotate with each other when the clutch plates 313*b* of the outer case 313*a* and the clutch plate 313*d* of the inner case 313*c* contact each other. On the other hand, the clutch section 313 becomes a disengaged state in which the outer case 313*a* and the inner case 313*c* do not rotate integrally when the clutch plates 313*b* of the outer case 313*a* and the clutch plates 313*d* of the inner case 313*c* are separated from each other.

More specifically, a piston 313*e* that is slidable on the inner periphery of the outer case 313*a* is disposed in the outer case 313*a*. This piston 313*e* moves the plural clutch plates 313*b* of the outer case 313*a* in a sliding direction of the piston 313*e* when the piston 313*e* is slid on the inner periphery of the outer case 313*a*. A compression coil spring 313*f* is also disposed in the outer case 313*a*. This compression coil spring 313*f* is arranged to urge the piston 313*e* in a direction that the clutch plates 313*b* of the outer case 313*a* and the clutch plates 313*d* of the inner case 313*c* are separated from each other. In addition, the piston 313*e* slides on the inner periphery of the outer case 313*a* against the reaction force of the compression coil spring 313*f* when the pressure of oil that flows through an oil passage 316*a* of the upper casing 316 is raised by the above-mentioned electromagnetic hydraulic control valve 37. Accordingly, it is possible to contact or separate the clutch plates 313*b* of the outer case 313*a* with/from the clutch plates 313*d* of the inner case 313*c* by raising or reducing the pressure of the oil flowing through the oil passage 316*a* of the upper casing 316. Therefore, the clutch section 313 can be engaged or disengaged.

The lower end portions of the four shaft members 319 are attached to the upper portion of the inner case 313*c*. In other words, the inner case 313*c* is connected through the four shaft members 319 and the flange members 318 to which upper portions of the four shaft members 319 are attached. Therefore, it is possible to simultaneously rotate the inner case 313*c*, the flange member 318, and the shaft members 319 about the axis L1.

By configuring the planetary gear train 312 and the clutch section 313 as described above, the ring gear 317 is rotated in the A direction in conjunction with the rotation of the upper transmission shaft 311 in the A direction when the clutch section 313 is disengaged. At this time, because the sun gear 321 is not rotated in a B direction, which is opposite to the A direction, each of the planetary gears 320, as shown in FIG. 6, moves with the shaft member 319 in an A2 direction around the axis L1 while rotating about the shaft member 319 in an A1 direction. Accordingly, the flange member 318 (see FIG. 5) is rotated about the axis L1 in the A direction in conjunction with the movement of the shaft members 319 in the A2 direction. Consequently, the intermediate shaft 315, which is preferably spline-fitted to the flange member 318, can be rotated about the axis L1 in the A direction while the rotational speed thereof is reduced from that of the upper transmission shaft 311.

By arranging the planetary gear train 312 and the clutch section 313 as described above, the ring gear 317 is rotated in the A direction in conjunction with the rotation of the upper transmission shaft 311 in the A direction when the clutch section 313 is engaged. At this time, because the sun gear 321 is not rotated in the B direction, which is opposite of the A direction, each of the planetary gears 320 moves with the shaft member 319 in the A2 direction around the axis L1 while rotating about the shaft member 319 in the A1 direction. Because the clutch section 313 is engaged in this state, the outer case 313*a* of the clutch section 313 (see FIG. 5) is rotated along with the one-way clutch 314 (see FIG. 5) in the A direction. Accordingly, because the sun gear 321 is rotated about the axis L1 in the A direction, the shaft members 319 move in the A direction around the axis L1 while the planetary gears 320 are not substantially rotated about the shaft members 319. The flange member 318 is not substantially decelerated by the planetary gears 320 and thus is rotated at approximately the same speed as the upper transmission shaft 311. Consequently, the intermediate shaft 315 can be rotated about the axis L1 in the A direction at generally the same speed as the upper transmission shaft 311.

As shown in FIG. 5, a lower transmission 330 is arranged below the upper transmission 310. The lower transmission 330 preferably includes an intermediate transmission shaft 331 connected to the intermediate shaft 315, a planetary gear train 332 arranged to decelerate a driving force of the intermediate transmission shaft 331, forward/backward switch clutch sections 333, 334 arranged to control rotation of the planetary gear train 332, a lower transmission shaft 335 to which the driving force of the intermediate transmission shaft 331 is transmitted through the planetary gear train 332, and a lower casing 336 that defines the contour of the lower transmission 330. The lower transmission 330 includes the lower transmission shaft 335 that rotates in the opposite direction (B direction) from the rotational direction (A direction) of the intermediate shaft 315 (upper transmission shaft 311) when the forward/backward switch clutch section 333 is engaged, and when the forward backward switch clutch section 334 is disengaged. In this case, the lower transmission 330 does not rotate the propeller 32*b* but only rotates the propeller 32*a* so that the boat 1 can travel backward. Meanwhile, the lower transmission 330 also includes the lower transmission shaft 335 that rotates in the same direction as the rotational direction (A direction) of the intermediate shaft 315 (upper transmission shaft 311) when the forward/backward switch clutch section 333 is disengaged, and when the forward/backward switch clutch section 334 is engaged. In this case, the lower transmission 330 rotates the propeller 32*a* in the opposite direction from a direction in which the propeller 32*a* is rotated to move the boat 1 backward, and also rotates the propeller 32*b* in an opposite direction from the rotational direction of the propeller 32*a*, so that the boat 1 can be propelled forward. Here, the lower transmission 330 is configured such that the forward/backward switch clutch sections 333, 334 are not engaged concurrently. In addition, the lower transmission 330 is configured (to be in the neutral state) that the rotation of the intermediate shaft 315 (upper transfer shaft 311) is not transmitted to the lower transmission shaft 335 when both of the forward/backward switch clutch sections 333 and 334 are disengaged.

Figure 7:
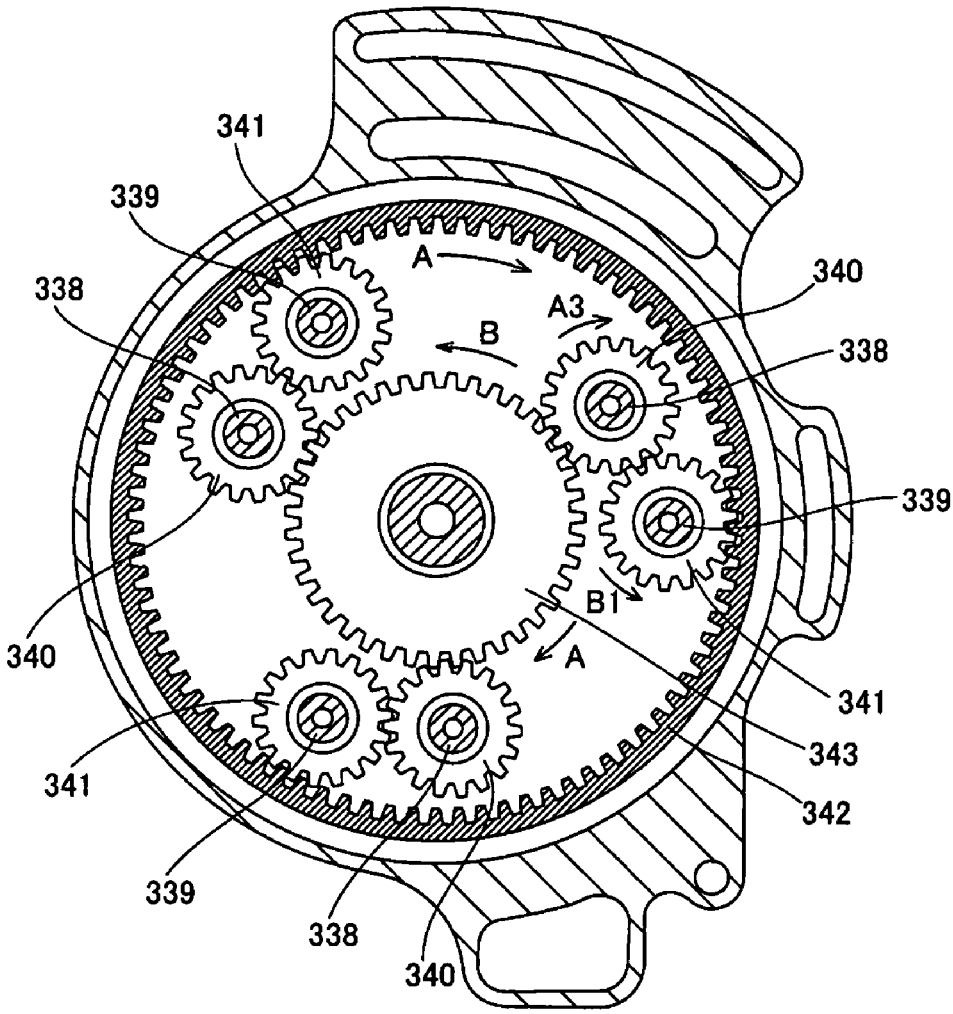
FIG. 7 is a cross-sectional view taken along the line 200-200 of FIG. 5.

More specifically, the intermediate transmission shaft 331 is arranged to rotate along with the intermediate shaft 315, and is provided with a flange 337 in a lower portion thereof. As shown in FIGS. 5 and 7, three inner shaft members 338 and three outer shaft members 339 are fixed to this flange 337. Three inner planetary gears 340 are each rotatably attached to the respective inner shaft members 338 and are meshed with a sun gear 343, which will be described below. Three outer planetary gears 341 are each rotatably attached to the respective outer shaft members 339. These three outer planetary gears 341 are each meshed with the respective inner planetary gear 340 and a ring gear 342, which will be described below.

The forward/backward switch clutch section 333 is provided in an upper portion inside the lower casing 336. This forward/backward switch clutch section 333 is preferably a wet-type multiplate clutch and is partially defined by a concave section 336*a* of the lower casing 336. In addition, the forward/backward switch clutch section 333 mainly includes plural clutch plates 333*a* that are disposed in the inner peripheral portion of the concave section 336*a* spaced a given distance from each other, an inner case 333*b* that is at least partially disposed on the inside of the concave section 336*a*, and plural clutch plates 333*c* that are attached to the inner case 333*b* and are disposed in the respective spaces between the plural clutch plates 333*a*. Moreover, the forward/backward switch clutch section 333 is configured such that the rotation of the inner case 333*b* is regulated by the lower casing 336 when the clutch plates 333*a* of the concave section 336*a* and the clutch plates 333*c* of the inner case 333*b* contact each other. Meanwhile, the forward/backward switch clutch section 333 is also configured such that the inner case 333*b* can freely rotate with respect to the lower casing 336 when the clutch plates 333*a* of the concave section 336*a* and the clutch plates 333*c* of the inner case 333*b* are separated from each other.

More specifically, a piston 333*d* that is slidable on the inner periphery of the concave section 336*a* is disposed in the concave section 336*a* of the lower casing 336. This piston 333*d* moves the clutch plates 333*a* of the concave section 336*a* in a sliding direction of the piston 333*d* when the piston 333*d* is slid on the inner periphery of the concave section 336*a*. A compression coil spring 333*e* is also disposed in the concave section 336*a* of the lower casing 336. This compression coil spring 333*e* is arranged to urge the piston 333*d* in a direction that the clutch plates 333*a* of the concave section 336*a* and the clutch plates 333*c* of the inner case 333*b* are separated from each other. In addition, the piston 333*d* slides on the inner periphery of the concave section 336*a* against the reaction force of the compression coil spring 333*e* when the pressure of oil that flows through an oil passage 336*b* of the lower casing 336 is raised by the above-mentioned electromagnetic hydraulic control valve 37. Accordingly, it is possible to engage or disengage the forward/backward switch clutch section 333 by raising or reducing the pressure of the oil that flows through the oil passage 336*b* of the lower casing 336.

The annular ring gear 342 is attached to the inner case 333*b* of the forward/backward switch clutch section 333. As shown in FIGS. 5 and 7, this ring gear 342 meshes with the three outer planetary gears 341.

As shown in FIG. 5, the forward/backward switch clutch section 334 is preferably a wet-type multiplate clutch and is disposed in the lower portion inside the lower casing 336. The forward/backward switch clutch section 334 mainly includes an outer case 334*a*, plural clutch plates 334*b* that are disposed in the inner peripheral portion of the outer case 334*a* with a given distance between each other, an inner case 334*c* that is at least partially disposed inside the outer case 334*a*, and plural clutch plates 334*d* that are attached to the inner case 334*c* and are disposed in the respective spaces of the plural multiple clutch plates 334*b*. In addition, the forward/backward clutch section 334 is configured that the inner case 334*c* and the outer case 334*a* are integrally rotated around the axis L1 when the clutch plates 334*b* of the outer case 334*a* and the clutch plates 334*d* of the inner case 334*c* contact with each other. On the other hand, the forward/backward clutch section 334 is configured such that the inner case 334*c* is freely rotated with respect to the outer case 334*a* when the clutch plates 334*b* of the outer case 334*a* and the clutch plates 334*d* of the inner case 334*c* are separated from each other.

More specifically, a piston 334*e* that is slidable on the inner periphery of the outer case 334*a* is disposed in the outer case 334*a*. This piston 334*e* moves the plural clutch plates 334*b* of the outer case 334*a* in a sliding direction of the piston 334*e* when the piston 334*e* is slid on the inner periphery of the outer case 334*a*. A compression coil spring 334*f* is also disposed on the inside of the outer case 334*a*. This compression coil spring 334*f* is arranged to urge the piston 334*e* in a direction that the clutch plates 334*b* of the outer case 334*a* are separated from the clutch plates 334*d* of the inner case 334*c*. In addition, the piston 334*e* slides on the inner periphery of the outer case 334*a* against the reaction force of the compression coil spring 334*f* when the pressure of oil that flows through an oil passage 336*c* of the lower casing 336 is raised by the above-mentioned electromagnetic hydraulic control valve 37. Accordingly, it is possible to engage or disengage the forward/backward switch clutch section 334 by raising or reducing the pressure of the oil that flows through the oil passage 336*c* of the lower casing 336.

The three inner shaft members 338 and the three outer shaft members 339 are fixed in the inner case 334*c* of the forward/backward switch clutch section 334. In other words, the inner case 334*c* is connected to the flange 337 with the three inner shaft members 338 and the three outer shaft members 339, and rotates about the axis L1 with the flange 337. In addition, the outer case 334*a* of the forward/backward switch clutch section 334 is attached to the lower transmission shaft 335, and rotates about the axis L1 with the lower transmission shaft 335.

The sun gear 343 is integral with the upper portion of the lower transmission shaft 335. As shown in FIG. 7, this sun gear 343 is meshed with the inner planetary gears 340, and the inner planetary gears 340 are meshed with the outer planetary gears 341 that are meshed with the ring gear 342. Then, the sun gear 343 rotates about the axis L1 in the B direction through the inner planetary gears 340 and the outer planetary gears 341 when the flange 337 is rotated in the A direction in conjunction with the rotation of the intermediate transmission shaft 331 about the axis L1 in the A direction in a case that the ring gear 342 does not rotate by being connected to the forward/backward switch clutch section 333.

By arranging the planetary gear train 332 and the forward/backward switch clutch sections 333, 334 as described above, the ring gear 342 that is attached to the inner case 333*b* is fixed to the lower casing 336 when the forward/backward switch clutch section 333 is engaged. At this time, because the forward/backward switch clutch section 334 is disengaged as described above, the outer case 334*a* and the inner case 334*c* of the forward/backward switch clutch section 334 can be rotated independently from each other. In this case, the three inner shaft members 338 and the three outer shaft members 339 are each rotated about the axis L1 in the A direction when the flange 337 is rotated about the axis L1 in the A direction in conjunction with the rotation of the intermediate transmission shaft 331 about the axis L1 in the A direction. At this time, the outer planetary gears 341 that are attached to the outer shaft members 339 are rotated about the outer shaft members 339 in a B1 direction. Meanwhile, the inner planetary gears 340 are rotated about the inner shaft members 338 in an A3 direction in conjunction with the rotation of the outer planetary gears 341. Accordingly, the sun gear 343 is rotated about the axis L1 in the B direction. Consequently, as shown in FIG. 5, the lower transmission shaft 335 is rotated with the outer case 334*a* about the axis L1 in the B direction regardless of the rotation of the inner case 334*c* about the axis L1 in the A direction. Therefore, the lower transmission shaft 335 can be rotated in the opposite direction (B direction) from the rotational direction (A direction) of the intermediate shaft 315 (upper transmission shaft 311) when the forward/backward switch clutch section 333 is engaged, and when the forward backward switch clutch section 334 is disengaged.

By configuring the planetary gear train 332 and the forward/backward switch clutch sections 333, 334 as described above, the ring gear 342 that is attached to the inner case 333*b* can freely rotate with respect to the lower casing 336 when the forward/backward switch clutch section 333 is disengaged. At this time, the forward/backward switch clutch section 334 can be engaged or disengaged as described above.

A case where the forward/backward switch clutch section 334 is engaged will be described next. As shown in FIG. 7, when the flange 337 is rotated in the A direction in conjunction with the rotation of the intermediate transmission shaft 331 about the axis L1 in the A direction, the three inner shaft members 338 and the three outer shaft members 339 are rotated about the axis L1 in the A direction. At this time, because the ring gear 342 that is meshed with the outer planetary gears 341 is freely rotated, the inner planetary gears 340 and the outer planetary gears 341 idle. In other words, the driving force of the intermediate transmission shaft 331 is not transmitted to the sun gear 343. Meanwhile, as shown in FIG. 5, because the forward/backward switch clutch section 334 is engaged, the outer case 334*a* is rotated about the axis L1 in the A direction in conjunction with the rotation of the inner case 334*c* about the axis L1 in the A direction. The inner case 334*c* is rotatable about the axis L1 in the A direction with the three inner shaft members 338 and the three outer shaft members 339. Accordingly, the lower transmission shaft 335 is rotated with the outer case 334*a* about the axis L1 in the A direction. Consequently, the lower transmission shaft 335 can be rotated in the same direction as the rotational direction (A direction) of the intermediate shaft 315 (upper transmission shaft 311) when the forward/backward switch clutch section 333 is disengaged, and the forward backward switch clutch section 334 is engaged.

As shown in FIG. 4, a reduction gear 344 is provided below the transmission mechanism 33. The lower transmission shaft 335 of the transmission mechanism 33 is received in this reduction gear 344. The reduction gear 344 functions to decelerate the driving force received by the lower transmission shaft 335. In addition, a drive shaft 345 is arranged under the reduction gear 344. This drive shaft 345 is configured to rotate in the same direction as the lower transmission shaft 335, and is provided with a bevel gear 345*a* in a lower portion thereof.

A bevel gear 346*a* of an inner output shaft 346 and a bevel gear 347*a* of an outer output shaft 347 are meshed with the bevel gear 345*a* of the drive shaft 345. The inner output shaft 346 is arranged to extend backward (in the arrow BWD direction), and the above-mentioned propeller 32*b* is attached to the inner output shaft 346 at the BWD direction end. Similar to the inner output shaft 346, the outer output shaft 347 is also arranged to extend in the arrow BWD direction, and the above-mentioned propeller 32*a* is attached to the outer output shaft 347 at the BWD direction end. The outer output shaft 347 is hollow, and the inner output shaft 346 is inserted in a hollow portion of the outer output shaft 347. The inner output shaft 346 and the outer output shaft 347 are configured to be independently rotatable from each other.

The bevel gear 346*a* is meshed with the bevel gear 345*a* at the FWD end, and the bevel gear 347*a* is meshed with the bevel gear 345*a* at the BWD end. Accordingly, when the bevel gear 346*a* rotates, the inner output shaft 346 and the outer output shaft 347 rotate in opposite directions from each other.

More specifically, when the drive shaft 345 rotates in the A direction, the bevel gear 346*a* is rotated in an A4 direction. In conjunction with the rotation of the bevel gear 346*a* in the A4 direction, the propeller 32*b* is rotated in the A4 direction through the inner output shaft 346. Meanwhile, when the drive shaft 345 rotates in the A direction, the bevel gear 347*a* rotates in a B2 direction. In conjunction with the rotation of the bevel gear 347*a* in the B2 direction, the propeller 32*a* is rotated in the B2 direction through the outer output shaft 347. Accordingly, the boat 1 is navigated in the arrow FWD direction (forward direction) due to the rotation of the propeller 32*a* in the B2 direction and the rotation of the propeller 32*b* in the A4 direction (the opposite direction from the B2 direction).

When the drive shaft 345 rotates in the B direction, the bevel gear 346*a* is rotated in the B2 direction. In conjunction with the rotation of the bevel gear 346*a* in the B2 direction, the propeller 32*b* is rotated in the B2 direction through the inner output shaft 346. Meanwhile, when the drive shaft 345 rotates in the B direction, the bevel gear 347*a* is rotated in the A4 direction. At this time, the outer output shaft 347 is configured not to be rotated in the A4 direction; therefore, the propeller 32*a* is rotated in neither the A4 direction nor the B2 direction. In other words, only the propeller 32*b* is rotated in the A4 direction. Then, the boat 1 is navigated in the arrow BWD direction (backward direction) due to the rotation of the propeller 32*b* in the B2 direction.

Figure 8:
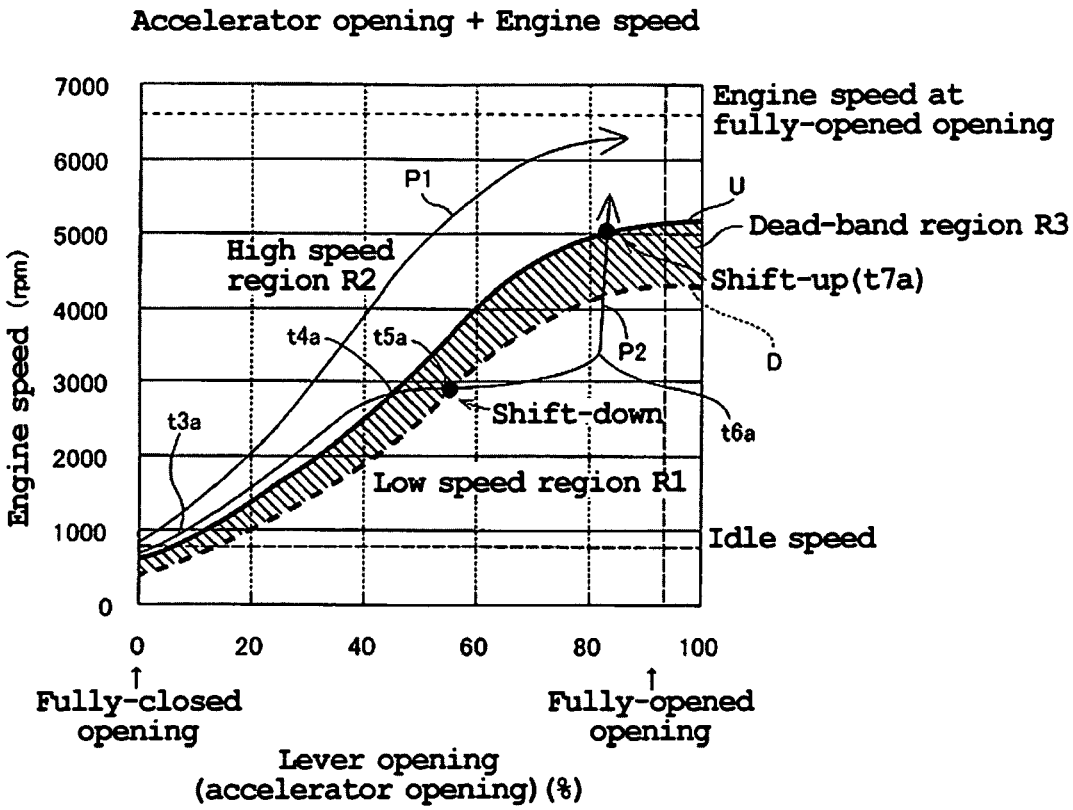
FIG. 8 is a view showing a gear shift control map stored in a memory of the propulsion system for a boat according to a preferred embodiment of the present invention.

FIG. 8 shows a gear shift control map stored in a memory of the propulsion system for a boat according to a preferred embodiment of the present invention. Next, referring to FIGS. 2, 3, and 8, the gear shift control map of the propulsion system for a boat according to a preferred embodiment of the present invention will be described.

As shown in FIG. 8, the gear shift control map according to this preferred embodiment indicates the correlation between the speed of the engine 31 and the lever opening (accelerator opening) of the lever portion 5*a* of the control lever section 5 (see FIG. 3). The longitudinal axis of this gear shift control map indicates the speed of the engine 31 while the horizontal axis thereof indicates the lever opening (accelerator opening) of the lever portion 5*a*. Here, the gear shift control map is an example of the "cavitation detecting section" according to a preferred embodiment of the present invention.

The gear shift control map includes a low speed region R1 defining a gear reduction ratio for low speed, a high speed region R2 defining a gear reduction ratio for high speed, and a dead-band region R3 that is provided between the boundaries of the low speed region R1 and the high speed region R2. Here, the low speed region R1, the high speed region R2, and the dead-band region R3 are respectively examples of a "first region", "second region", and "third region" according to a preferred embodiment of the present invention. In addition, the gear shift control map according to this preferred embodiment is utilized for both the forward and backward movements of the boat 1.

The dead-band region R3 in the gear shift control map is provided to prevent frequent shifting of gears. In other words, if a trajectory of the lever opening (accelerator opening signal) based on the user's operation of the lever portion 5*a* of the control lever section 5 (see FIG. 3) and the speed of the engine 31 (engine rotation signal) (see FIG. 3) transmitted from the ECU 34 is located in the dead-band region R3, the gear reduction ratio is not changed. This dead-band region R3 is provided as a band-like zone between a shift-down reference line D that is provided in the low speed region R1 for defining the gear reduction ratio for low speed and a shift-up reference line U that is provided in the high speed region R2 for defining the gear reduction ratio for high speed. In addition, the dead-band region R3 is adapted to increase the difference between the speed of the engine 31 on the shift-down reference line D and that on the shift-up reference line U as the lever opening of the lever portion 5*a* of the control lever section 5 increases. Here, the shift-down reference line D is an example of the "first reference line" of the present invention, and the shift-up reference line U is an example of the "second reference line" according to a preferred embodiment of the present invention.

In this preferred embodiment, the control unit 52 is arranged to detect cavitation generated along with the rotation of the propellers 32*a* and 32*b* (see FIG. 3) on the basis of the trajectory of the lever opening (accelerator opening signal), which is based on the user's operation, and the speed of the engine 31 (engine rotation signal), which is transmitted from the ECU 34 (see FIG. 2), on the gear shift control map. In other words, in this preferred embodiment, the "cavitation detecting section" of the present invention is defined by the control unit 52 and the gear shift control map. Here, cavitation is a phenomenon of mass formation of vapor bubbles in a region proximate to the propellers 32*a* and 32*b* in conjunction with the rotation of the propellers 32*a* and 32*b* in a liquid (water), which reduces or indicates the possible reduction of propulsive force of the boat 1.

Figure 9:
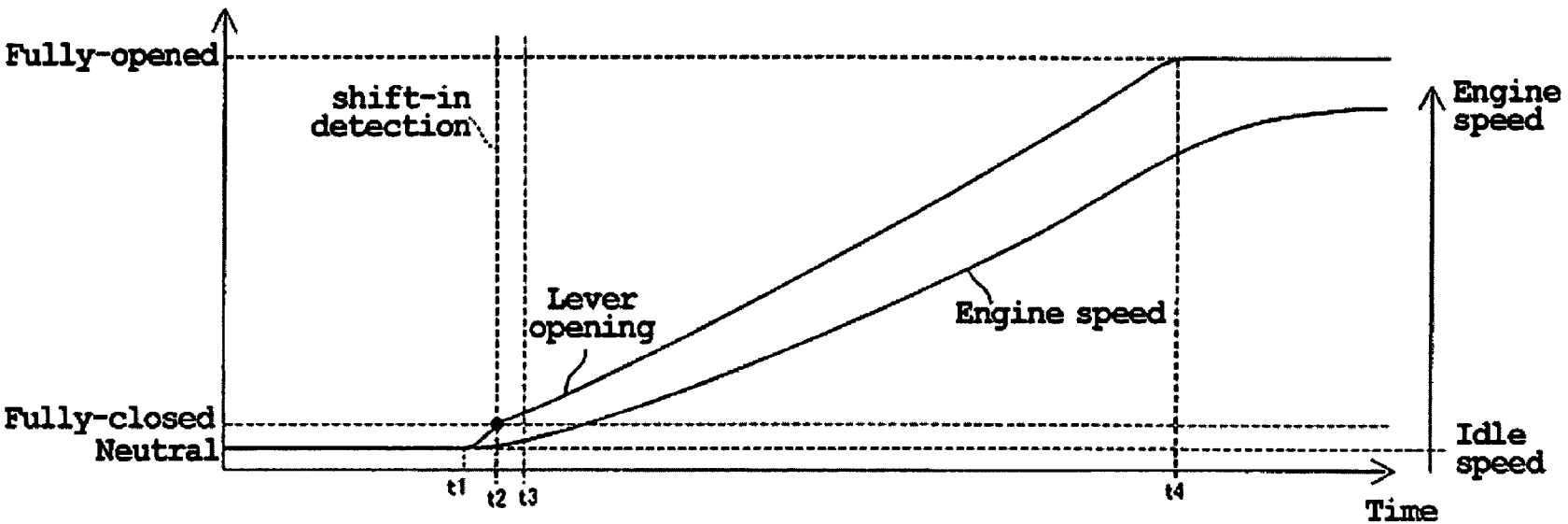
FIG. 9 is a timing chart indicating a correlation between time and engine speed of the propulsion system for a boat according to a preferred embodiment of the present invention.
Figure 10:
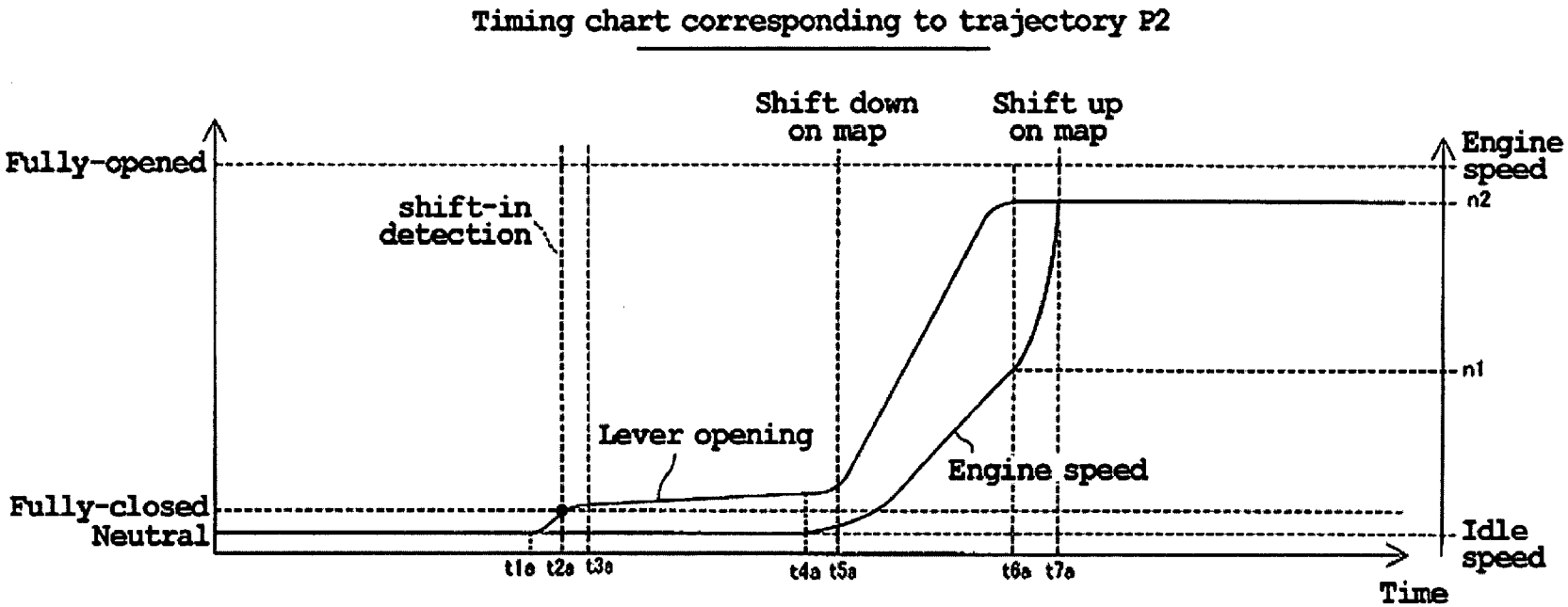
FIG. 10 is a timing chart indicating the correlation between time and the engine speed of the propulsion system for a boat according to a preferred embodiment of the present invention.

FIGS. 9 and 10 are timing charts indicating the correlation between time and the engine speed of the propulsion system for a boat according to the embodiment of the present invention. Referring to FIGS. 2, 3, 5, and 8 to 10, next will be described processing of a gear shift operation that utilizes the gear shift control map according to a preferred embodiment.

In the preferred embodiment, shown in FIG. 8, the control unit 52 is arranged to control a change in the gear reduction ratio of the transmission mechanism 33 on the basis of the gear shift control map (see FIG. 8) that indicates a standard to change the gear reduction ratio of the transmission mechanism 33 by utilizing the speed of the engine 31 (engine rotation signal) and the lever opening of the lever portion 5*a* of the control lever section 5. More specifically, the control unit 52 performs different gear shift controls in accordance with the trajectories P1 and P2 of the lever opening (accelerator opening signal), which is based on the user's operation, and the speed of the engine 31 (engine rotation signal), which is transmitted from the ECU 34, on the gear shift control map.

First, gear shift operation by the transmission mechanism 33 will be described for a case when, as shown in the trajectory P1 in FIG. 8, the user slowly turns the lever portion 5*a* of the control lever section 5 from the neutral position (position on the solid line in FIG. 3) to a fully opened position (FWD2 in FIG. 3). In this case, it is conceivable that the user desires to slowly accelerate the hull 2.

In the above case, as an operation to reach a state of fully-closed opening shown in FIG. 8, the lever portion 5*a* of the control lever 5 is turned by the user from the neutral state at a time t1 to the fully closed position (FWD1 in FIG. 3) in order to reach the fully closed state (at a time t2), as shown in FIG. 9. At this time, the gear reduction ratio of the transmission mechanism 33 is temporarily (from the time t2 to a time t3) shifted to the gear reduction ratio for low speed. In this case, as shown in FIG. 2, the control unit 52 transmits the gear switch signal, which changes the gear reduction ratio of the transmission mechanism 33 to the gear reduction ratio for low speed, to the ECU 34. Then, the ECU 34 that received the gear switch signal transmits the electromagnetic hydraulic control valve drive signal to the electromagnetic hydraulic control valve 37 so that only the forward/backward switch clutch section 334 of the lower transmission 330 (see FIG. 5) becomes engaged. Accordingly, the piston 334*e* (see FIG. 5) is moved to make the clutch plates 334*b* (see FIG. 5) contact the clutch plates 334*e* (see FIG. 5) as the pressure of the oil in the oil passage 336*c* is raised by the electromagnetic hydraulic control valve 37. Therefore, the forward/backward switch clutch section 334 (see FIG. 5) becomes engaged. Consequently, the transmission mechanism 33 shifts the gear so that the boat 1 can travel forward with the gear reduction ratio for low speed.

Then, as shown in FIG. 9, the transmission mechanism 33 is shifted to have the gear reduction ratio for high speed at the time t3. More specifically, as shown in FIG. 2, the control unit 52 transmits the gear switch signal for switching the transmission mechanism 33 to have the gear reduction ratio for high speed to the ECU 34. Then, the ECU 34 that received the gear switch signal transmits the electromagnetic hydraulic control valve drive signal to the electromagnetic hydraulic control valve 37 so that both the clutch section 313 of the upper transmission 310 (see FIG. 5) and the forward/backward switch clutch section 334 of the lower transmission 330 (see FIG. 5) become engaged. Accordingly, the piston 313*e* (see FIG. 5) is moved to make the clutch plates 313*b* (see FIG. 5) and the clutch plates 313*d* (see FIG. 5) contact each other as the pressure of the oil in the oil passage 316*a* (see FIG. 5) is raised by the electromagnetic hydraulic control valve 37. Therefore, the clutch section 313 (see FIG. 5) becomes engaged. At this time, because the forward/backward switch clutch section 334 is engaged, the forward/backward switch clutch section 334 is controlled to maintain its engaged state. Consequently, the transmission mechanism 33 shifts the gear so that the boat 1 can travel forward with the gear reduction ratio for high speed.

Then, from the time t3 to a time t4, the lever portion 5*a* is turned by the user's operation from the fully-closed position (FWD1 in FIG. 3) to the fully-opened position (FWD2 in FIG. 3). At this time, as shown in FIG. 8, the lever opening (accelerator opening) of the lever portion 5*a* and the speed of the engine 31 are changed as indicated in the trajectory P1 on the gear shift control map. Because this trajectory P1 moves only within the high speed region R2, the gear reduction ratio of the transmission mechanism 33 is not changed from the gear reduction ratio for high speed. Therefore, the boat 1 can accelerate in the forward direction while minimizing an increase in the speed of the engine 31. In the above case, the boat 1 is accelerated in accordance with the user's desire for slow acceleration.

Next, a gear shift operation in the transmission mechanism 33 will be described for a case that, as shown in a trajectory P2 in FIG. 8, the user slowly turns the lever portion 5*a* of the control lever section 5 from the neutral position (position on the solid line in FIG. 3) to a position between the fully closed position (FWD1 in FIG. 3) and the fully opened position (FWD2 in FIG. 3), and then rapidly turns the lever portion 5*a* to the fully opened position from the position between the fully closed position and the fully opened position. In this case, it is conceivable that the user desires to rapidly accelerate after slowly accelerating the hull 2.

As an operation to reach the fully closed opening state shown in FIG. 8, the lever portion 5*a* of the control lever section 5 is turned by the user's operation from the neutral position at a time t1*a* to the fully closed position (FWD 1 in FIG. 3) to become fully closed (at a time t2*a*), as shown in FIG. 10. At this time, the gear reduction ratio of the transmission mechanism 33 is temporarily (from the time t2*a* to a time t3*a*) shifted to the gear reduction ratio for low speed. Consequently, the transmission mechanism 33 shifts the gears so that the boat 1 can travel forward with the gear reduction ratio for low speed. The detailed explanation under this condition is the same as the timing chart that corresponds with the trajectory P1 shown in FIG. 9, and thus is omitted.

Then, at the time t3*a*, the transmission mechanism 33 is shifted to have the gear reduction ratio for high speed. Accordingly, the transmission mechanism 33 shifts the gear so that the boat 1 can travel forward with the gear reduction ratio for high speed. The detailed explanation under this condition is the same as the timing chart that corresponds with the trajectory P1 shown in FIG. 9, and thus is omitted.

Then, from the time t3*a* to the time t4*a*, the lever 5*a* is slowly turned by the user's operation in the FWD2 direction (see FIG. 3) between the fully closed position and the fully opened position. At this time, as shown in FIG. 8, the lever opening (accelerator opening) of the lever portion 5*a* and the speed of the engine 31 are changed in accordance with the trajectory P2 on the gear shift control map. Because this trajectory P2 moves only within the high speed region R2 from the time t3*a* to a time t5*a*, the gear reduction ratio of the transmission mechanism 33 is not shifted from the gear reduction ratio for high speed. Therefore, the hull 2 is slowly accelerated under this condition.

Then, as shown in FIG. 10, from the time t4*a* to a time t6*a*, the lever portion 5*a* is rapidly turned from the position between the fully closed position and the fully opened position to the fully opened position (FWD2 in FIG. 3) by the user's operation. In this case, at the time t5*a*, as shown in FIG. 8, the trajectory P2 crosses the dead-band region R3 from the high speed region R2 and also crosses a shift-down reference line D. Accordingly, the gear reduction ratio of the transmission mechanism 33 is shifted from the gear reduction ratio for high speed to the gear reduction ratio for low speed. Consequently, the transmission mechanism 33 shifts the gear so that the boat 1 can travel forward with the gear reduction ratio for low speed, and it becomes possible to rapidly accelerate the boat 1.

Here, as shown in FIGS. 8 to 10, there is a case in this preferred embodiment that the lever opening (accelerator opening) rapidly increases from the time t6*a* to a time t7*a*. In this case, as shown in FIG. 8, at the time t7*a*, the speed of the engine 31 increases, and the trajectory P2 crosses the dead-band region R3 from the low speed region R1 and also crosses a shift-up reference line U. Accordingly, the gear reduction ratio of the transmission mechanism 33 is shifted from the gear reduction ratio for low speed to the gear reduction ratio for high speed. Consequently, the transmission mechanism 33 shifts the gear so that the boat 1 can travel forward with the gear reduction ratio for high speed. The detailed explanation under this condition is the same as the timing chart that corresponds with the trajectory P1 shown in FIG. 9, and thus is omitted.

The rapid increase in the speed of the engine 31 from the time t6*a* to the time t7*a* is considered to be a phenomenon caused by cavitation that is generated in conjunction with the rotation of the propellers 32*a* and 32*b*. The control unit 52 is thus configured to recognize that the above phenomenon is caused by cavitation. In other words, when cavitation is detected in a state that the gear reduction ratio of the transmission mechanism 33 is the gear reduction ratio for low speed as described above, the control unit 52 transmits the gear switch signal to the ECU 34 so that the transmission mechanism 33 shifts its gear to have the gear reduction ratio for high speed.

Figure 11:
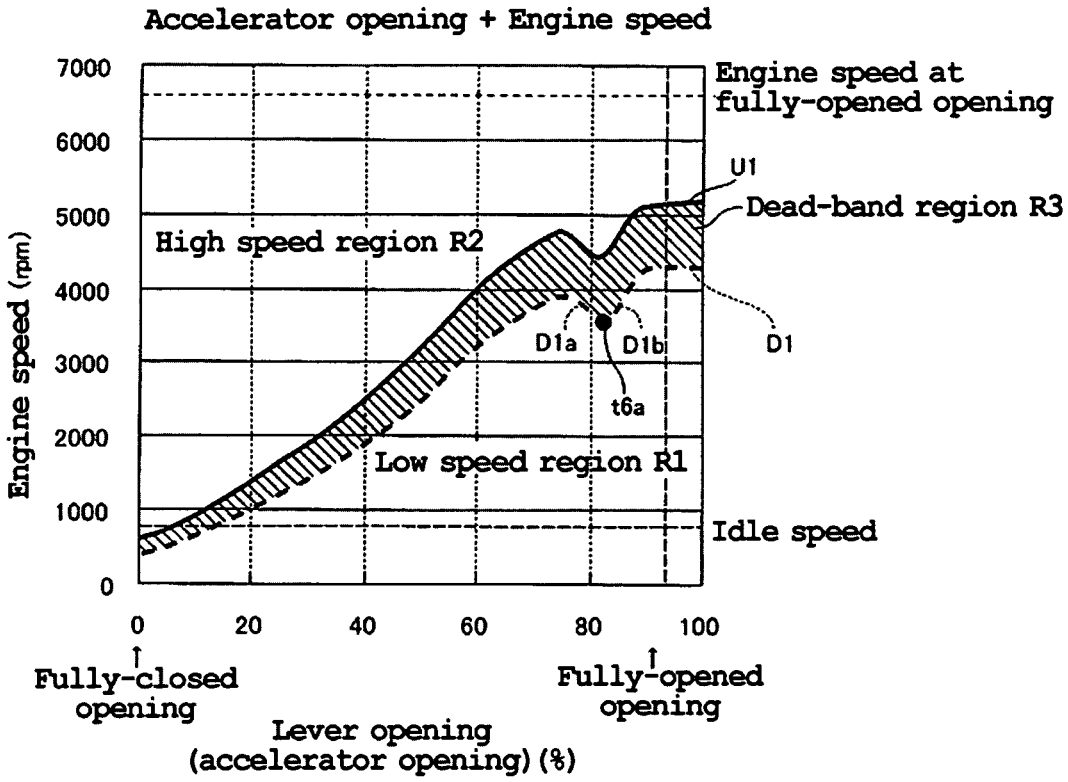
FIG. 11 is a view showing a gear shift control map corrected by a control unit of the propulsion system for a boat according to a preferred embodiment of the present invention.

FIG. 11 shows a gear shift control map corrected by the control unit of the propulsion system for a boat according to a preferred embodiment of the present invention. Next is a description of process of the control unit 52 for recognizing that the above phenomenon is caused by cavitation.

In this preferred embodiment, the control unit 52 is configured to recognize the occurrence of cavitation when a speed increase of the engine 31 exceeds a given speed increase (n2−n1) within a given time period (t6*a*-t7*a*). More specifically, as shown in FIG. 10, the control unit 52 is configured to recognize the occurrence of cavitation when the speed of the engine 31 increases to or exceeds the speed n2 from the speed n1 within the given time period from the starting point t6*a* to the endpoint t7*a*. For example, in this preferred embodiment, the control unit 52 is configured to recognize the occurrence of cavitation when the speed of the engine 31 increases from approximately 3,000 rpm to approximately 5,000 rpm in about one second, for example. However, if the weight of the hull 2 and the sizes of the propellers 32*a*, 32*b* differ from those in this preferred embodiment, different values are applied for a given time period and given engine speeds.

In this preferred embodiment, the control unit 52 is configured to differentiate the speed of the engine 31 with respect to time. This calculation is conducted at regular time intervals (approximately 10 msec. to approximately 100 msec., for example), and is conducted for a plurality of times during the above given period (t6*a* to t7*a*). Accordingly, it is possible to calculate plural derivatives (differential values) of the speed of the engine 31 in the above given period (t6*a* to t7*a*). Then, the control unit 52 is configured to recognize the occurrence of cavitation when plural differential values that exceed a given value are calculated during the above given period from the starting point t6*a* to the end point t7*a*. The starting point (t6*a*) is recognized by the control unit 52 on the basis of a point where a first differential value that exceeds the given value is calculated. The plural calculations of the differential values that exceed the given value over the given time period indicate that the speed of the engine 31 continues its rapid increase at a rate surpassing a given increase rate for the given time period. The control unit 52 is configured to recognize the occurrence of cavitation in such a case.

In this preferred embodiment, the control unit 52 corrects the gear shift control map stored in the memory 51 by utilizing the speed of the engine 31 and the lever opening (accelerator opening) based on the user's operation at a time when the occurrence of cavitation is recognized. This correction is made to control the gear reduction ratio of the transmission mechanism 33 by changing the shift-down reference line D and the shift-up reference line U on the gear shift control map on the basis of the starting point (t6*a*) of the occurrence of cavitation that is recognized by the control unit 52.

More specifically, in this preferred embodiment, the control unit 52 corrects the shift-down reference line D so that the shift-down reference line D is changed to a line D1 that includes the starting point (t6*a*) of the cavitation occurrence as shown in FIG. 11. This corrected line D1 includes: a line D1*a* that is curved from a point where the accelerator opening (lever opening) is narrower than the starting point (t6*a*) of the shift-down reference line D to the starting point (t6*a*); and a line D1*b* that is curved from a point where the accelerator opening (lever opening) is wider than the starting point (t6*a*) of the shift-down reference line D to the starting point (t6*a*). The lines D1*a* and D1*b* are connected to each other at the starting point (t6*a*).

In addition, in this preferred embodiment, when making the above correction to the shift-down reference line D, the control unit 52 also makes a correction to the shift-up reference line U so that the shift-up reference line D is changed to a line U1 whose shape is substantially the same as the corrected shift-down reference line D. In other words, this corrected line U1 has a shape that protrudes in a direction where the speed of the engine 31 is lower.

As described above, this preferred embodiment provides the transmission mechanism 33 arranged to transmit the driving force generated by the engine 31 to the propellers 32*a* and 32*b* in a state that the driving force of the engine 31 is changed its speed at least with the gear reduction ratio for low speed or high speed. Therefore, it is possible to improve the accelerating performance at low speed by arranging the transmission mechanism 33 such that the transmission mechanism 33 can transmit the driving force generated by the engine 31 to the propellers 32*a* and 32*b* in a state that the driving force is changed its speed with the gear reduction ratio for low speed. In addition, it is possible to increase the maximum speed by arranging the transmission mechanism 33 such that the transmission mechanism 33 can transmit the driving force generated by the engine 31 to the propellers 32*a* and 32*b* in a state that the driving force is changed its speed with the gear reduction ratio for high speed. Consequently, both the acceleration and maximum speed can be brought closer to the performance levels that the user desires.

By arranging the control unit 52 to detect cavitation that occurs in conjunction with the rotation of the propellers 32*a* and 32*b*, it is possible to easily detect the occurrence of cavitation by the control unit 52.

Upon detection of cavitation, the control unit 52 is arranged to transmit the gear switch signal to the ECU 34 on the basis of the trajectory on the gear shift control map so that the transmission mechanism 33 is shifted to have the gear reduction ratio for high speed. Therefore, when the speed of the engine 31 exceeds a speed that corresponds to a degree of the accelerator opening (lever opening) due to the cavitation occurrence, the transmission mechanism 33 can be shifted to have the gear reduction ratio for high speed. In this case, because torque of the engine 31 decreases while resistance of the propellers 32*a* and 32*b* against water remains the same, the speeds of the engine 31 and the propellers 32*a* and 32*b* can be reduced. As a result, because the cavitation dies down, it is possible to suppress a decrease in propulsive force of the propellers 32*a* and 32*b*.

In these preferred embodiments, as described above, the control unit 52 is configured to recognize the occurrence of cavitation when the speed of the engine 31 continues to increase at the rate that exceeds the given increase rate over the given time period (from the starting point t6*a* to the end point t7*a*). Therefore, it is possible to distinguish a case where the propellers 32*a* and 32*b* are moved above the water surface from a case where the speed of the engine 31 increases temporarily (momentarily).

In these preferred embodiments, it is also possible to calculate a differentiate value of the speed of the engine 31 by configuring the control unit 52 to differentiate the speed of the engine 31 with respect to time. In addition, the occurrence of cavitation is recognized when the differential values that exceed the given value are calculated for a plurality of times during the above given period from the starting point t6*a* to the end point t7*a*. Therefore, it is easily recognizable whether cavitation occurs or not.

In these preferred embodiments, as described above, the control unit 52 is arranged to control a change of the gear reduction ratio of the transmission mechanism 33 on the basis of the gear shift control map that indicates the standard for changing the gear reduction ratio of the transmission mechanism 33 by utilizing the speed of the engine 31 (engine rotation signal) and the lever opening of the lever portion 5*a* of the control lever section 5 (accelerator opening signal). Therefore, if the engine 31 is at low speed with respect to a degree of the lever opening of the lever portion 5*a* that is operated by the user, the gear reduction ratio of the transmission mechanism 33 can be changed to the gear reduction ratio for low speed so as to increase the speed of the engine 31. In other words, when the user abruptly widens the opening amount of the lever portion 5*a* of the control lever section 5 for the purpose of rapid acceleration, the rapid increase in the rotational speeds of the propellers 32*a* and 32*b* is made possible by changing the gear reduction ratio of the transmission mechanism 33 to the gear reduction ratio for low speed for the improved acceleration performance. Meanwhile, when the user slowly widens the opening of the lever portion 5*a* of the control lever section 5 for the intension of slow acceleration, the transmission mechanism 33 can be controlled to change its reduction gear ratio to the reduction gear for high speed for a slow increase in the speeds of the propellers 32*a* and 32*b*. Accordingly, it is possible to suppress an increase in the speed of the engine 31, and thus, it is possible to prevent excessive fuel consumption by the engine 31.

In these preferred embodiments, as described above, the control unit 52 is configured to control a change in the gear reduction ratio to the gear reduction ratio for low speed when the trajectory P2 of the lever opening (accelerator opening), which is based on the user's operation, and the speed of the engine 31 enters the low speed region R1 from the high speed region R2 through the dead-band region R3 on the gear shift control map. Compared to a case where the gear reduction ratio of the transmission mechanism 33 remains the gear reduction ratio for high speed, this enables to increase the speed of the engine 31 again. Therefore, it is possible to suppress a decrease in the acceleration of the boat 1.

In these preferred embodiments, as described above, the control unit 52 is arranged to control a change in the gear reduction ratio to the gear reduction ratio for high when the trajectory P2 of the lever opening (accelerator opening), which is based on the user's operation, and the speed of the engine 31 enters the high speed region R2 from the low speed region R1 through the dead-band region R3 on the gear shift control map. Accordingly, it is possible to increase the maximum speed of the boat 1 in comparison with a case where the gear reduction ratio of the transmission mechanism 33 remains the gear reduction ratio for low speed.

In these preferred embodiments, as described above, the control unit 52 is arranged to correct the gear shift control map on the basis of the starting point (t6*a*) of the cavitation occurrence and to control a change in the gear reduction ratio of the transmission mechanism 33 on the basis of the corrected gear shift control map. Therefore, it is possible to obtain the gear shift control map by which the transmission mechanism 33 can change the gear reduction ratio at a point near the starting point (t6*a*) of the cavitation occurrence. Accordingly, because it is possible to promptly shift up at the occurrence of cavitation, the cavitation can die down promptly.

In these preferred embodiments, as described above, the shift-down reference line D is corrected to be changed to the line D1 that includes the starting point (t6*a*) of the cavitation occurrence. Therefore, for example, in a state where the trajectory of the lever opening (accelerator opening) and the speed of the engine 31 is located in the high speed region R2, even if the trajectory is dropped near the starting point (t6*a*) of the cavitation occurrence, it is possible to prevent the trajectory from entering the low speed region R1. Accordingly, the gear reduction ratio of the transmission mechanism 33 can be changed to the gear reduction ratio for low speed in a region where the speed of the engine 31 is lower than that at the starting point (t6*a*) of the cavitation occurrence. Consequently, it is possible to suppress the occurrence of cavitation.

In these preferred embodiments, as described above, the control unit 52 is arranged to make a correction to change the shift-up reference line U to the line U1 that has substantially the same shape as the corrected line D1. Therefore, it is possible to change the gear reduction ratio of the transmission mechanism 33 when the trajectory of the lever opening (accelerator opening) and the speed of the engine 31 passes the proximity of the starting point (t6*a*) of the cavitation occurrence. Accordingly, the transmission mechanism 33 can change the reduction ratio immediately after the occurrence of cavitation.

It should be understood that the preferred embodiments of the present invention disclosed herein are merely exemplary in all respects and that it is not intended in any way to limit the scope of the present invention. The scope of the present invention is not defined by the description of the above preferred embodiments but defined by the scope of the claims, and includes the meanings equivalent to those of the scope of the claims as well as any modifications that fall within the scope of the claims.

For example, the above preferred embodiments illustrate an example of the propulsion system for a boat that preferably includes two outboard engines in which an engine and a propeller are disposed outside a hull. However, the present invention is not limited to the above, and is also applicable to another type of the propulsion system for a boat that includes a stern drive in which an engine is fixed to a hull or that includes an inboard motor in which an engine and a propeller are fixed to the hull, for example.

The above preferred embodiments illustrate an example in which the cavitation detecting section of the present invention is preferably constituted by the gear shift control map and the control unit 52. However, the present invention is not limited to the above. The cavitation detecting section may be defined by a sensor arranged to detect the cavitation occurrence, or the control unit 52 may only be utilized for the detection of the cavitation occurrence without the gear shift control map, for example.

The above preferred embodiments illustrate an example of correcting the shift-down reference line to the line that preferably includes the starting point of the cavitation occurrence as an example of correction on the gear shift control map. However, the present invention is not limited to the above, and the shift-up reference line may be corrected to include the starting point of the cavitation occurrence, for example.

The above preferred embodiments illustrate an example of preferably correcting both the shift-down reference line and the shift-up reference line as an example of correction on the gear shift control map. However, the present invention is not limited to the above, and only one of the shift-down reference line and the shift-up reference line may be corrected, for example.

The above preferred embodiments illustrate an example of the outboard motor preferably provided with two propellers as an example of a propulsion system for a boat. However, the present invention is not limited to the above, and is also applicable to another type of the propulsion system for a boat that includes an outboard motor equipped with one or more than two propellers, for example.

The above preferred embodiments illustrate an example that preferably includes two outboard motors. However, the present invention is not limited to the above, and one or more than two outboard motors can be included, for example. In addition, if plural outboard motors are provided, they can be set up for simultaneous gear shifts. In this case, one of the outboard motors may be designated as a main motor, and it may be set up to shift gears of the other outboard motors when a transmission mechanism of the main motor shifts the gear. Moreover, each ECU of the plural outboard motors may transmit a gear shift control signal not only to its own transmission mechanism but also to the transmission mechanisms of the other outboard motors, and each of the transmission mechanisms may be arranged to shift the gears based on the gear shift control signal that is transmitted faster than the other gear shift control signals from the plural ECUs.

The above preferred embodiments illustrate an example in which the gear shift control map for the backward travel of the boat is preferably configured in the same manner as one for the forward travel of the boat. However, the present invention is not limited to the above, and two gear shift control maps may be provided, one is specialized for the forward travel and the other is specialized for the backward travel, for example.

The above preferred embodiments illustrate an example in which the control unit and the ECU can preferably communicate with each other as being connected by the common LAN cables. However, the present invention is not limited to the above, and the control unit and the ECU may be connected with each other through wireless communication, for example.

The above preferred embodiments utilize the rotational speed of the crankshaft as an example of the engine speed. However, the present invention is not limited to the above. For example, rotational speed of a member (shaft) other than the crankshaft, which rotates along with the crankshaft in the engine, such as a propeller or an output shaft may be utilized.

The above preferred embodiments illustrate an example in which the accelerator opening and the reduction gear ratio of the transmission mechanism 33 preferably are electrically controlled (by electronic control) by operating the lever portion 5*a* of the control lever 5. However, the present invention is not limited to the above. For example, the accelerator opening and the gear reduction ratio of the transmission mechanism 33 may be controlled by connecting a wire to the lever 5*a* such that the opening of the lever portion 5*a* is mechanically transmitted to the outboard motor 3 as an operating amount and an operating direction of the wire. In this case, the operating amount and the operating direction of the wire are converted into an electric signal between the lever portion 5*a* and the ECU 34 in the outboard motor 3. The converted electric signal is then transmitted to the ECU 34. In addition, in this case, the gear shift control map is stored in the ECU 34 provided in the outboard motor 3, and the ECU 34 outputs a control signal (such as the electromagnetic hydraulic control valve drive signal) for controlling the transmission mechanism 33.

The above preferred embodiments illustrate an example in which the gear shift control map is preferably stored in the memory 51 that is contained in the control lever section 5 and that a control signal to change the gear reduction ratio is transmitted to the transmission mechanism 33 from the control unit 52 housed in the control lever section 5. However, the present invention is not limited to the above, and the gear shift control map may be stored in the ECU 34 that is provided in the outboard motor 3, for example. In addition, the ECU 34, which stores the gear shift control map, may be configured to output a control signal. In this case, in addition to the ECU 34 for controlling the engine, another ECU may be provided in the outboard motor to store the speed change control map and output a control signal. This variant example is also applicable to a case where the lever portion 5*a* of the control 5 mechanically controls the accelerator opening and the reduction ratio of the transmission mechanism 33 by wire as described above.

The above preferred embodiments illustrate an example, in which switching among the forward travel, neutral state, and backward travel is conducted by the lower transmission 300 that is electrically controlled by the ECU. However, the present invention is not limited to the above. As the outboard motor disclosed above in JP-A-Hei 9-263294, a mechanical forward/backward switch mechanism that is defined by a pair of bevel gears and a dog clutch may switch among the forward travel, neutral state, and backward travel, for example.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A propulsion system for a boat, the propulsion system comprising:

an engine;

a propeller arranged to be rotated by the engine;

a transmission mechanism arranged to operate in at least a low speed gear reduction ratio and a high speed gear reduction ratio, and arranged to transmit a driving force of the engine in a state where a speed of the driving force is changed to one of the low speed gear reduction ratio and the high speed gear reduction ratio;

a control lever section arranged to be operated by a user when the engine drive is controlled;

a control unit arranged to output a signal to control a gear change in the transmission mechanism on the basis of an amount of a lever opening, which is based on the user's operation of the control lever section, and a speed of the engine; and a cavitation detecting section arranged to detect cavitation generated in conjunction with rotation of the propeller; wherein the control unit is arranged to control an output of a signal to the transmission mechanism to change the gear reduction ratio to the high speed gear reduction ratio when cavitation is detected by the cavitation detecting section.

2. The propulsion system for a boat according to claim 1, wherein the cavitation detection section is arranged to recognize an occurrence of the cavitation when the engine speed increases to exceed a given engine speed within a given time period.

3. The propulsion system for a boat according to claim 1, wherein the cavitation detection section is arranged to recognize an occurrence of the cavitation when the engine speed continues to increase at a higher rate than a given increase rate for a given time period.

4. The propulsion system for a boat according to claim 3, wherein the cavitation detecting section is arranged to differentiate the engine speed with respect to time, and is also arranged to recognize the occurrence of the cavitation when a plurality of differential values that exceed a given value are calculated in the given time period.

5. The propulsion system for a boat according to claim 1, wherein the control unit is arranged to control a change in a gear reduction ratio of the transmission mechanism on the basis of a gear shift control map that indicates a standard value arranged to indicate when to change the gear reduction ratio of the transmission mechanism by utilizing the engine speed and opening of the lever portion based on the user's operation.

6. The propulsion system for a boat according to claim 5, wherein the gear shift control map includes a first region defining a low speed gear reduction ratio, a second region defining a high speed gear reduction ratio, and a third region provided between boundaries of the first region and the second region; and the control unit is arranged to control a change in the gear reduction ratio to the low speed gear reduction ratio when a trajectory of the lever opening based on the user's operation and the engine speed enters the first region from the second region through the third region on the gear shift control map.

7. The propulsion system for a boat according to claim 6, wherein the control unit is arranged to control a change in the gear reduction ratio to the high speed gear reduction ratio when the trajectory of the lever opening based on the user's operation and the engine speed enters the second region from the first region through the third region on the gear shift control map.

8. The propulsion system for a boat according to claim 5, wherein the control unit is arranged to correct the gear shift control map by utilizing the engine speed and the lever opening based on the user's operation at the time when the cavitation detecting section recognizes the occurrence of the cavitation.

9. The propulsion system for a boat according to claim 8, wherein the control unit is arranged to correct the gear shift control map on the basis of a starting point of the cavitation occurrence that is recognized by the cavitation detecting section, and is also arranged to control a change in the gear reduction ratio of the transmission mechanism on the basis of the corrected gear shift control map.

10. The propulsion system for a boat according to claim 8, wherein the gear shift control map includes a first region defining the low speed gear reduction ratio, a second region defining the high speed gear reduction ratio, and a third region provided between boundaries of the first region and the second region;

the third region of the gear shift control map is a zone between a first reference line provided in the first region defining the low speed gear reduction ratio and a second reference line provided in the second region defining the high speed gear reduction ratio; and the control unit is arranged to correct the first reference line by changing it to a line that includes a starting point of the cavitation occurrence recognized by the cavitation detecting section.

11. The propulsion system for a boat according to claim 10, wherein the control unit is arranged to correct the second reference line to have substantially the same shape as the corrected first reference line when correcting the first reference line to include a point on the gear shift control map.

12. The propulsion system for a boat according to claim 5, further comprising a memory arranged to store the gear shift control map.

13. The propulsion system for a boat according to claim 1, further comprising a control lever section that is arranged to be operated by a user when the engine is controlled and arranged to adjust the amount of lever opening.

* * * * *